US009102485B2

(12) United States Patent
Deno

(10) Patent No.: US 9,102,485 B2
(45) Date of Patent: Aug. 11, 2015

(54) SHEET CONVEYANCE APPARATUS AND IMAGE FORMING APPARATUS

(71) Applicant: CANON KABUSHIKI KAISHA, Tokyo (JP)

(72) Inventor: Kouhei Deno, Moriya (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/512,314

(22) Filed: Oct. 10, 2014

(65) Prior Publication Data

US 2015/0102555 A1 Apr. 16, 2015

(30) Foreign Application Priority Data

Oct. 15, 2013 (JP) ..... 2013-214817

(51) Int. Cl.
*B65H 9/00* (2006.01)
*B65H 9/10* (2006.01)
*B65H 7/02* (2006.01)

(52) U.S. Cl.
CPC ..... *B65H 9/106* (2013.01); *B65H 9/002* (2013.01); *B65H 7/02* (2013.01); *B65H 2301/331* (2013.01); *B65H 2301/3613* (2013.01); *B65H 2301/3621* (2013.01)

(58) Field of Classification Search
CPC .. B65H 9/002; B65H 9/106; B65H 2301/331; B65H 2301/3613; B65H 2301/3621
USPC ..... 271/252–254; 414/791.2
See application file for complete search history.

(56) References Cited

U.S. PATENT DOCUMENTS

| | | | | |
|---|---|---|---|---|
| 7,722,039 | B2 * | 5/2010 | Shoji et al. | 271/273 |
| 8,985,578 | B2 * | 3/2015 | Muneyasu et al. | 271/246 |
| 2005/0035539 | A1 * | 2/2005 | Hashimoto | 271/265.01 |
| 2008/0054553 | A1 * | 3/2008 | Muneyasu et al. | 271/240 |
| 2008/0232879 | A1 * | 9/2008 | Shoji et al. | 399/395 |
| 2008/0240821 | A1 * | 10/2008 | Shoji et al. | 399/395 |
| 2009/0060608 | A1 * | 3/2009 | Shoji et al. | 399/394 |
| 2012/0153565 | A1 * | 6/2012 | Deno | 271/226 |
| 2013/0214482 | A1 * | 8/2013 | Matsumoto | 271/228 |
| 2013/0285316 | A1 * | 10/2013 | Deno | 271/229 |
| 2013/0334769 | A1 * | 12/2013 | Yamazaki | 271/228 |

FOREIGN PATENT DOCUMENTS

JP 2008-50069 A 3/2008

* cited by examiner

*Primary Examiner* — Patrick Cicchino
(74) *Attorney, Agent, or Firm* — Canon USA, Inc., IP Division

(57) ABSTRACT

A sheet conveyance apparatus includes a conveyance roller pair, an urging portion, a releasing portion, and a moving portion. The conveyance roller pair includes a first roller and a second roller, and conveys a sheet. The urging portion applies a pinching force to the conveyance roller pair. The releasing portion releases the pinching force of the conveyance roller pair against an urging force of the urging portion. The moving portion moves the conveyance roller pair, the urging portion, and the releasing portion in a width direction intersecting with a sheet conveyance direction.

11 Claims, 7 Drawing Sheets

FIG.3A
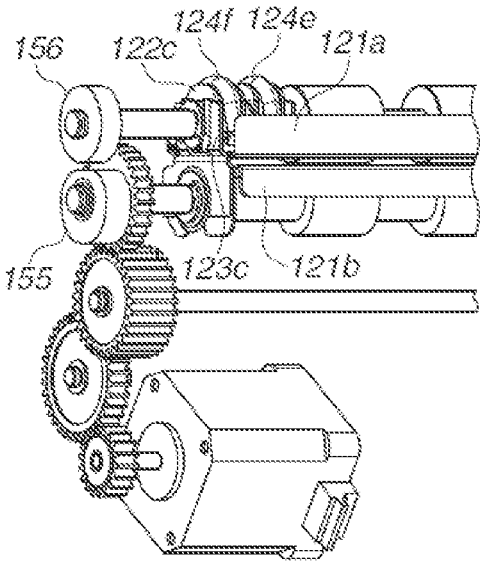
FIG.3B
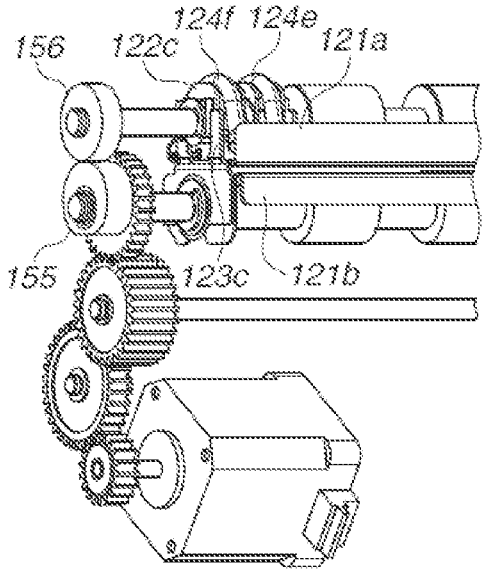
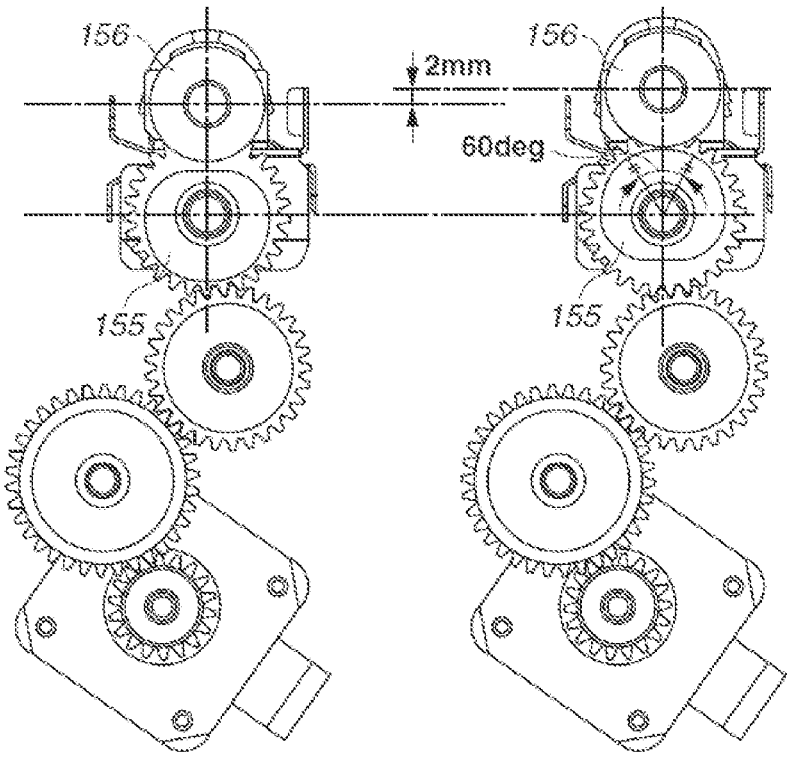
FIG.3C

SHEET CONVEYANCE APPARATUS AND IMAGE FORMING APPARATUS

BACKGROUND OF THE INVENTION

1. Field of the Invention

The present invention relates to a sheet conveyance apparatus configured to convey sheets, and to an image forming apparatus equipped with this sheet conveyance apparatus.

2. Description of the Related Art

Conventionally, in an image forming apparatus, in order to perform registration between a sheet and an image to be formed thereon, there have been provided a skew correction mechanism for correcting skew of the sheet being conveyed, and a width direction correction mechanism for correcting the position of the sheet in a direction orthogonal to the sheet conveyance direction (hereinafter referred to as the width direction as appropriate).

Japanese Patent Application Laid-Open No. 2008-50069 discusses a skew correction mechanism for correcting an orientation of a conveyed sheet to be straight if it is inclined. Further, Japanese Patent Application Laid-Open No. 2008-50069 discusses a width direction correction mechanism for correcting deviation of a sheet from a conveyance reference position in the width direction caused during the conveyance of the sheet or at the time of skew correction by the skew correction mechanism.

In the configuration discussed in Japanese Patent Application Laid-Open No. 2008-50069, positional correction in the width direction is performed on the sheet by moving a lateral registration roller pair, which pinches the sheet, in the width direction. The lateral registration roller pair exerts a pinching force by being pressed by a spring. Further, the configuration discussed in Japanese Patent Application Laid-Open No. 2008-50069 has a mechanism for releasing the pinching force of the lateral registration roller pair by a releasing lever and a releasing follower.

In the configuration discussed in Japanese Patent Application Laid-Open No. 2008-50069, however, a sliding-contact force against the above-mentioned force is exerted when the lateral registration roller pair is moved in the width direction, with the pinching force of the lateral registration roller pair being released.

SUMMARY OF THE INVENTION

The present invention is directed to a sheet conveyance apparatus and an image forming apparatus capable of reducing a sliding-contact force due to an urging portion applying a pinching force to a conveyance roller pair when the conveyance roller pair is moved in a state in which the pinching force of the conveyance roller pair is released.

According to an aspect of the present invention, a sheet conveyance apparatus includes a conveyance roller pair that includes a first roller and a second roller, and is configured to convey a sheet, an urging portion configured to apply a pinching force to the conveyance roller pair, a releasing portion configured to release the pinching force of the conveyance roller pair against an urging force of the urging portion, and a moving portion configured to move the conveyance roller pair, the urging portion, and the releasing portion in a width direction intersecting with a sheet conveyance direction.

Further features of the present invention will become apparent from the following description of exemplary embodiments with reference to the attached drawings.

BRIEF DESCRIPTION OF THE DRAWINGS

FIGS. 3A, 3B, and 3C are diagrams illustrating in detail a conveyance roller attaching/detaching mechanism according to the first exemplary embodiment.

DESCRIPTION OF THE EMBODIMENTS

Overall Configuration of Image Forming Apparatus

In the following, an exemplary embodiment of the present invention will be described with reference to the drawings.

Figure 7:
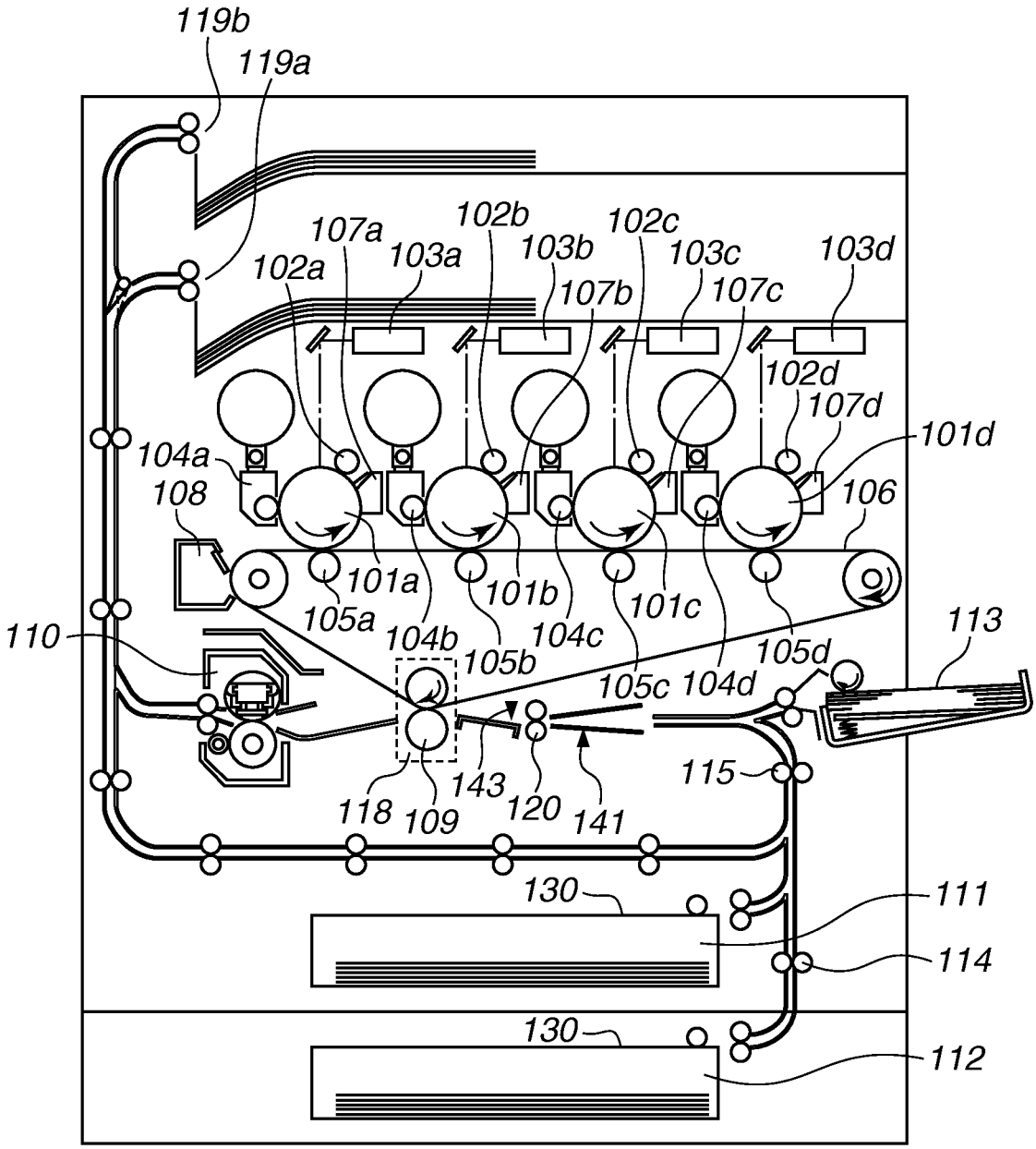
FIG. 7 is a diagram illustrating an overall configuration of the image forming apparatus according to the first exemplary embodiment.

FIG. 7 is a schematic sectional view of a color digital printer as an example of an image forming apparatus including a sheet conveyance apparatus according to a first exemplary embodiment of the present invention.

First, an image forming unit will be described. The surfaces of four photosensitive drums 101*a* through 101*d* are charged to a uniform electric charge by charging rollers 102*a* through 102*d*, respectively. Image signals of yellow (Y), magenta (M), cyan (C), and black (K) are input to laser scanners 103*a* through 103*d*, respectively, and, in response to these image signals, laser light is applied to the drum surfaces corresponding to the image signals to neutralize the electric charge and to form latent images.

The latent images formed on the photosensitive drums are developed by developing devices 104*a* through 104*d*, using yellow, magenta, cyan, and black toners, respectively. The toner images on the photosensitive drums thus developed are successively transferred to an intermediate transfer belt 106, which is an image bearing member in the form of an endless belt, by primary transfer rollers 105*a* through 105*d*, forming a full color toner image on the intermediate transfer belt 106.

A sheet fed from either of sheet feeding units of sheet feeding cassettes 111 and 112 is conveyed toward a registration roller pair 120 by an upstream roller pair 115. A sheet fed from a manual feed unit 113 is also conveyed to the registration roller pair 120. The toner image on the intermediate transfer belt 106 is controlled so as not to be misaligned with the sheet conveyed by the registration roller pair 120. The toner image is transferred to the sheet by a secondary transfer outer roller 109. Then, the toner image is heated and pressurized by a fixing device 110 to be fixed to the sheet. Thereafter, the sheet is discharged to the outside of the apparatus main body from a discharge unit 119*a* or 119*b*.

A side regulation plate has a function to prevent skew of the sheet and positional deviation in the width direction thereof caused during the sheet conveyance. Actually, however, when a slight gap is generated between the side regulation plate and the sheet, skew of the sheet and positional deviation in the width direction thereof may occur. Further, skew and lateral-registration deviation may occur during the conveyance of the fed sheet.

Therefore, in the present exemplary embodiment, the leading edge of the conveyed sheet is caused to abut on the nip portion of the registration roller pair 120 at rest, and the leading edge of the sheet is caused to extend along the nip portion while forming a loop in the sheet, thereby correcting the skew of the sheet. At this time, it is necessary to convey the sheet by the upstream roller pair 115 so that the leading edge of the sheet abuts on the nip portion of the registration roller pair 120, with the leading edge of the sheet extending along the nip portion.

Between the registration roller pair 120 and the secondary transfer unit 118, there is arranged a contact image sensor (CIS) 143 as a detection unit for detecting the position of the sheet in the width direction (a direction orthogonal to the conveyance direction). After the start of the sheet conveyance by the registration roller pair 120, a deviation amount between the detection result obtained by the CIS 143 and the nominal position (normal position) is calculated as a positional deviation correction amount in the width direction. Then, the registration roller pair 120 is shifted (moved) in the thrust direction (width direction) by the above positional deviation correction amount in the width direction, whereby the position of the sheet in the width direction is corrected.

(Description of the Configuration and the Mechanism of the Registration Unit)

Figure 1:
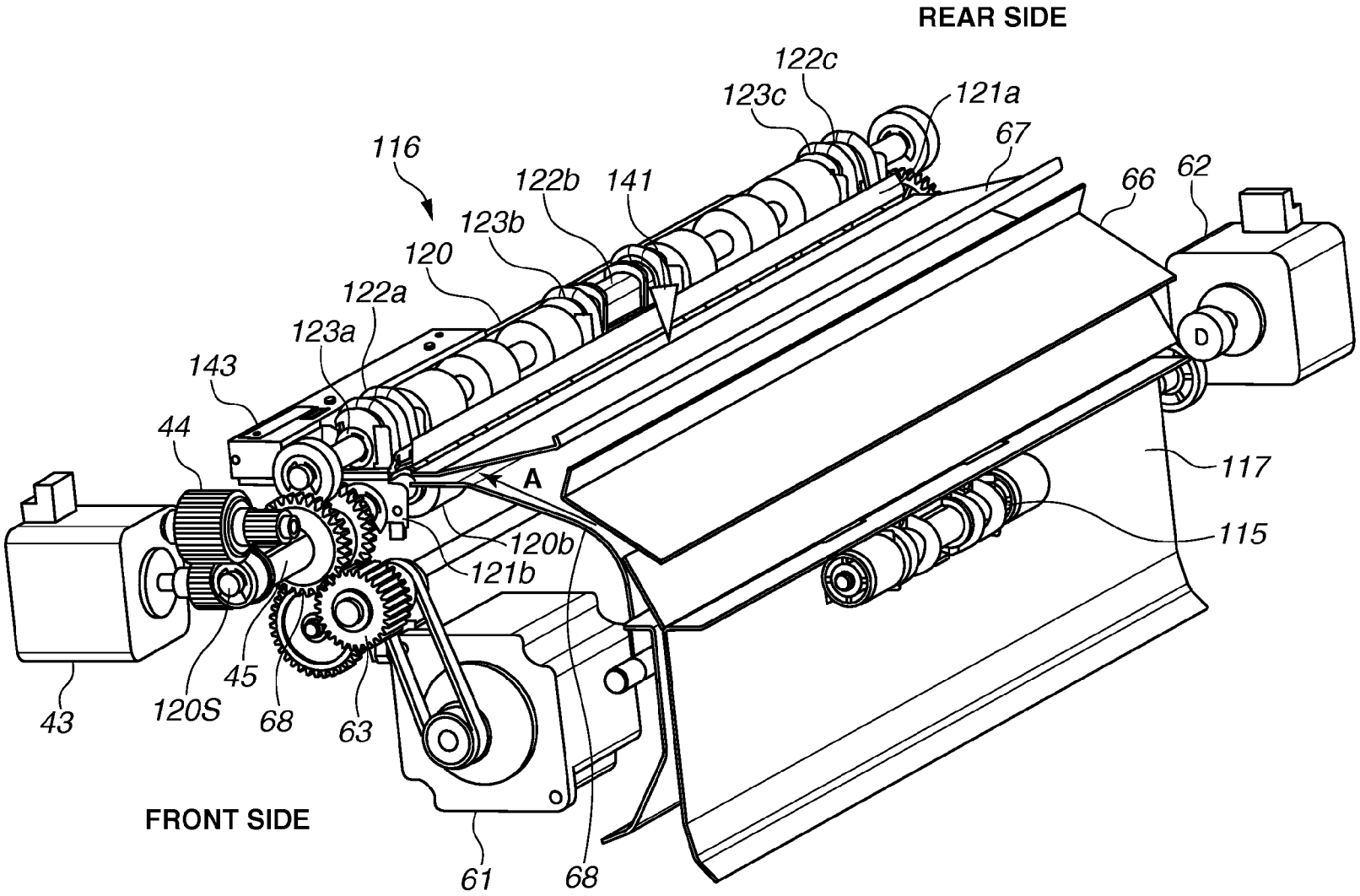
FIG. 1 is a perspective view of a sheet conveyance apparatus seen from the front side according to a first exemplary embodiment of the present invention.

Next, a sheet conveyance apparatus according to the first exemplary embodiment will be described with reference to the drawings. A sheet conveyance apparatus 116 is provided at some midpoint in the sheet conveyance path connecting the sheet feeding cassettes 111 and 112 and the image forming unit. FIG. 1 is a perspective view of the sheet conveyance apparatus 116 as seen from the front side.

The sheet conveyance path in the vicinity of the registration roller pair 120 is composed of a conveyance upper guide 121*a* and a conveyance lower guide 121*b*, with the conveyance upper guide 121*a* and the conveyance lower guide 121*b* being formed integrally. The conveyance upper guide 121*a* and the conveyance lower guide 121*b* are arranged so as to guide the sheet conveyed from the upstream roller pair 115 to the nip portion of the registration roller pair 120.

The registration roller pair 120 has an upper roller (first roller) 120*a* having a polyacetal (POM) roller, and a lower roller (second roller) 120*b* formed by a rubber roller arranged opposing the upper roller 120*a*. A rotation shaft 120*s* rotating integrally with the lower roller 120*b* is rotatably supported by a conveyance lower guide 121*b* via a bearing or the like. The upper roller 120*a* is rotatably supported via a plurality of bearings 122*a*, 122*b*, and 122*c*.

The bearings 122*a*, 122*b*, and 122*c* are fixed in position so as not to move in the sheet conveyance direction with respect to spring peg members 123*a*, 123*b*, and 123*c* provided integrally with the conveyance upper guide 121*a*. Further, the bearings 122*a*, 122*b*, and 122*c* are retained so as to be movable in the direction away from the lower roller 120*b*. Springs (urging portions) 124*a* through 124*f* are engaged in a U-shaped fashion with hook portions formed on the spring peg members 123*a*, 123*b*, and 123*c*, whereby the upper roller 120*a* is pressurized by the lower roller 120*b*, and the sheet pinching force is given. More specifically, the springs give a pinching force (urging force) to the registration roller pair 120.

In FIG. 1, a registration motor 61 generates the drive force for rotating the registration roller pair 120, and an upstream roller drive motor 62 generates the drive force for rotating the upstream roller pair 115.

A shift mechanism (moving portion) for moving the sheet in the width direction is configured as follows. The lower roller 120*b* of the registration roller pair 120 is fixed to the rotation shaft 120S, and the rotation shaft 120S is fixed to the apparatus main body so as to be movable in the width direction. As the rotation shaft 120S moves in the width direction, the upper roller 120*a* and the lower roller 120*b* integrally move in the width direction.

A pinion gear 44 is rotated by a drive force from a shift motor 43, and a rack 45 is translated. The rack 45 is rotatable in the rotational direction with respect to the rotation shaft 120S, and is supported while being fixed in the width direction. As a result, the registration roller pair 120 is capable of moving in the width direction, allowing the sheet pinched by the registration roller pair 120 to be moved in the width direction.

Compared with an input gear 68, an idler gear 63 has a larger tooth width. Thus, even when the registration roller 120 and the input gear 68 make a thrust movement, the mesh-engagement of the gears is maintained, allowing the registration roller pair 120 to rotate. Detection of the positional deviation amount in the width direction is performed by the CIS 143. The CIS 143 is arranged before the image transfer unit in the conveyance direction. Further, the CIS 143 is arranged offset from the center in the width direction. This is because it is sufficient to detect the side end portion of one side of the sheet even if the sheet has a minimum width or a maximum width.

Figure 2:
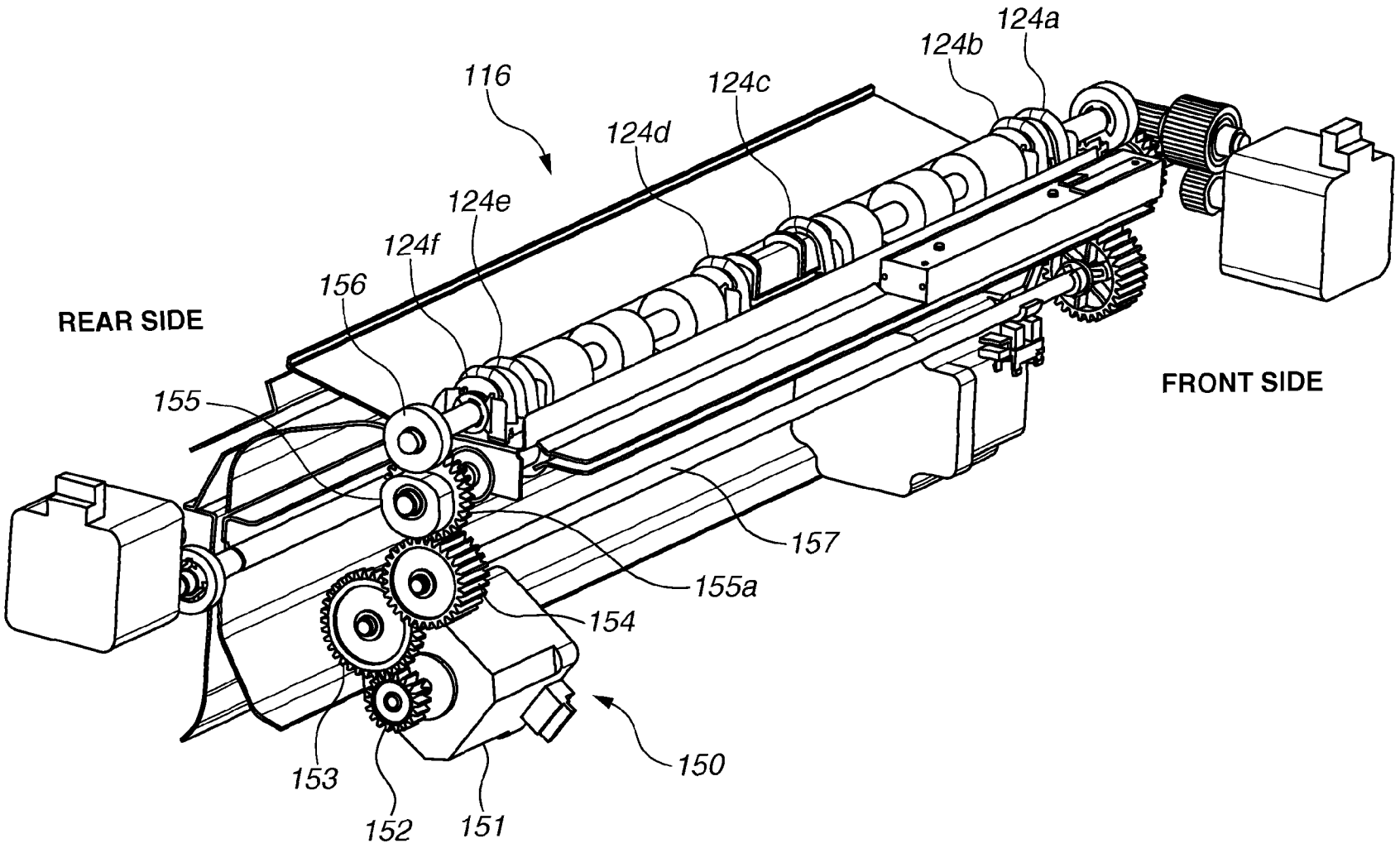
FIG. 2 is a perspective view of the sheet conveyance apparatus seen from the rear side according to the first exemplary embodiment.

Next, a separation mechanism (releasing unit) 150 configured to separate the registration roller pair 120 against the urging force of the springs 124*a* through 124*f* will be described with reference to FIGS. 2, 3A, 3B, and 3C. FIG. 2 is a perspective view seen from the rear side of the sheet conveyance apparatus 116, FIG. 3A is a diagram illustrating the contact state of the registration roller pair 120, and FIG. 3B is a diagram illustrating the separation state thereof. FIG. 3C is a diagram illustrating a comparison between the contact state and the separation state of the registration roller pair 120.

The separation mechanism 150 is configured to separate the upper roller 120*a* from the lower roller 120*b*. This enables the sheet pinching force to be reduced to zero, i.e., to release the sheet.

A drive force from an attaching/detaching motor 151 is transmitted to a motor input gear 152, an idler gear 153, and a cam input gear 154, and drives a cam gear 155*a* connected with a cam 155. When the cam gear 155*a* as a second gear in mesh with the cam input gear 154 as a first gear rotates, the cam 155 rotates. These gears and cam are symmetrically arranged at the front and rear sides of the apparatus main body, and the drive force from the attaching/detaching motor 151 at the rear side is transmitted to the front side via a cam shaft 157.

The external form of the cam 155 is eccentric with respect to the rotational center axis. When the distance from the center axis to the cam external form is the shortest, the registration roller pair 120 is in the contact state (FIG. 3A). On the other hand, when the distance from the center axis to the cam external form is the longest, the cam 155 pushes up a cam follower 156, whereby the registration roller pair 120 is placed in the separated state (FIG. 3B). The cam follower 156 is arranged so as to be coaxially rotatable with the upper roller 120*a*, and the cam 155 is arranged so as to be coaxially rotatable with the lower roller 120*b*. The cam follower 156 is pushed up by the cam 155, whereby the upper roller 120*a* is separated from the lower roller 120*b*. Here, as illustrated in FIG. 3C, the separation amount is 2 mm. In the present exemplary embodiment, the cam 155 and the cam follower 156 constitute the separation mechanism (releasing unit) 150.

In the cam profile in the separated state (see, e.g., FIGS. 3B and 3C), a 60 degree region has a fixed radius, and torque applied to the cam 155 is substantially zero. As a result, the separated state can be maintained even if the drive force of the attaching/detaching motor 151 is turned off.

Further, the cam 155 is rotatably supported by a bearing or the like with respect to the rotation shaft 120*s*, and operates independently of the driving by the registration motor 61. More specifically, even if the registration motor 61 rotates the rotation shaft 120*s*, the cam 155 does not rotate.

The shift mechanism moves the following members integrally in the width direction: the registration roller pair 120, the conveyance upper guide 121*a* and the conveyance lower guide 121*b*, the spring peg members 123*a*, 123*b*, and 123*c*, the springs 124*a* through 124*f*, the cam 155, and the cam follower 156. A tooth width of the cam input gear 154 is set to be large so that the mesh-engagement between the cam 155 and the cam input gear 154 can be maintained even if the cam 155 is shifted. Thus, even if the cam 155 is shifted, the drive force from the attaching/detaching motor 151 is transmitted from the cam input gear 154 to the cam 155.

(Description of the Correction Operation on Positional Deviation in the Width Direction, and of the Registration Roller Attaching/Detaching Operation)

Next, the sheet skew correction operation and the positional deviation correction operation in the width direction by the sheet conveyance apparatus 116, and the separating operation of the registration roller pair 120 will be described with reference to the drawings.

Figure 4:
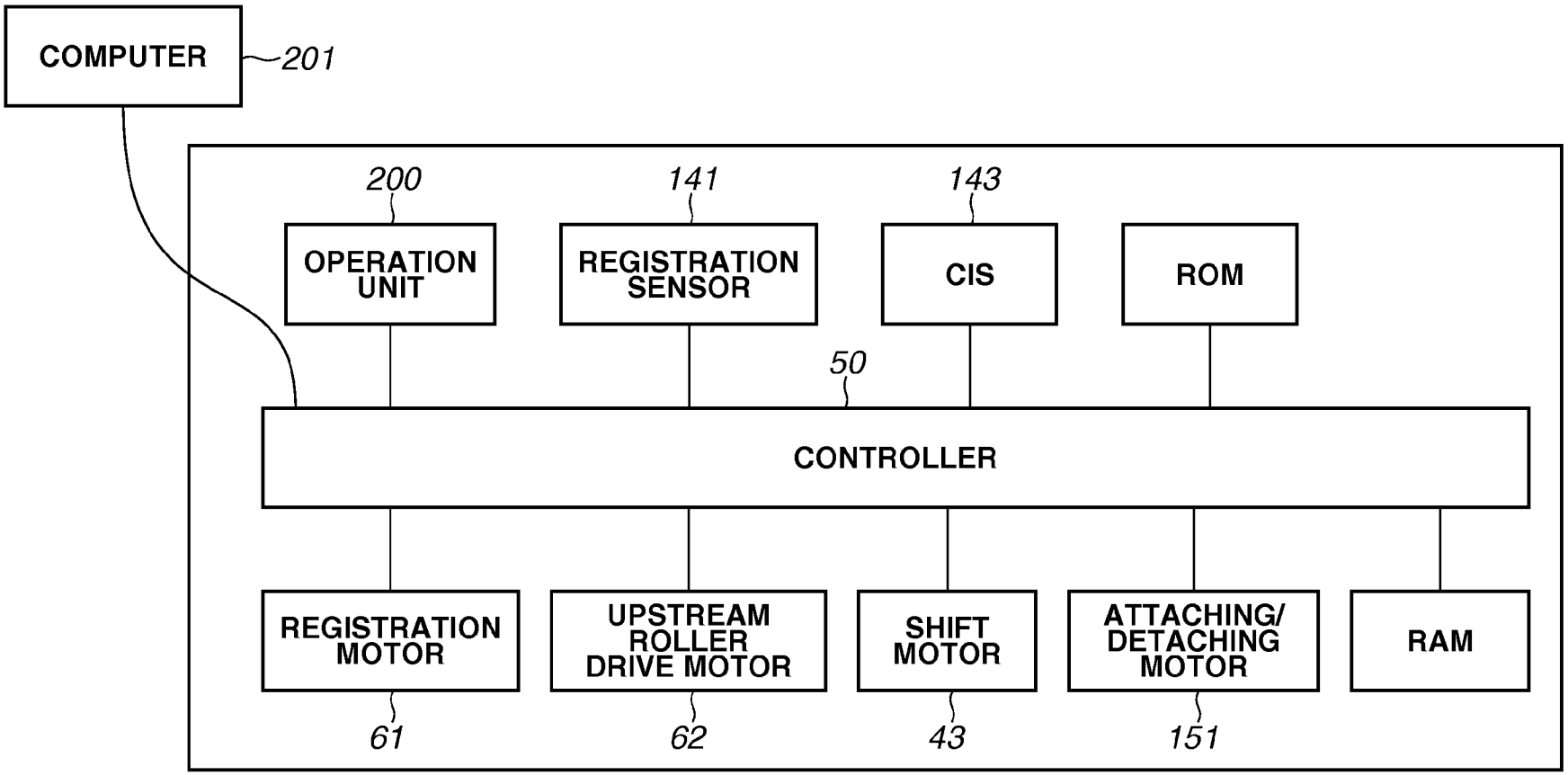
FIG. 4 is a block diagram illustrating an image forming apparatus according to the first exemplary embodiment.

As illustrated in the block diagram of FIG. 4, a controller 50 as a control unit is connected to an operation unit 200 of the image forming apparatus. Further, the controller 50 is connected to the registration motor 61, the upstream roller drive motor 62, the shift motor (drive source) 43, the attaching/detaching motor (drive source) 151, the registration sensor 141, and the CIS 143. Further, the controller 50 is connected to a read-only memory (ROM) and a random-access memory (RAM). The controller 50 uses the RAM as a work memory, whereby a program stored in the ROM storing a program corresponding to the procedures illustrated in FIG. 5 is executed.

Figure 5:
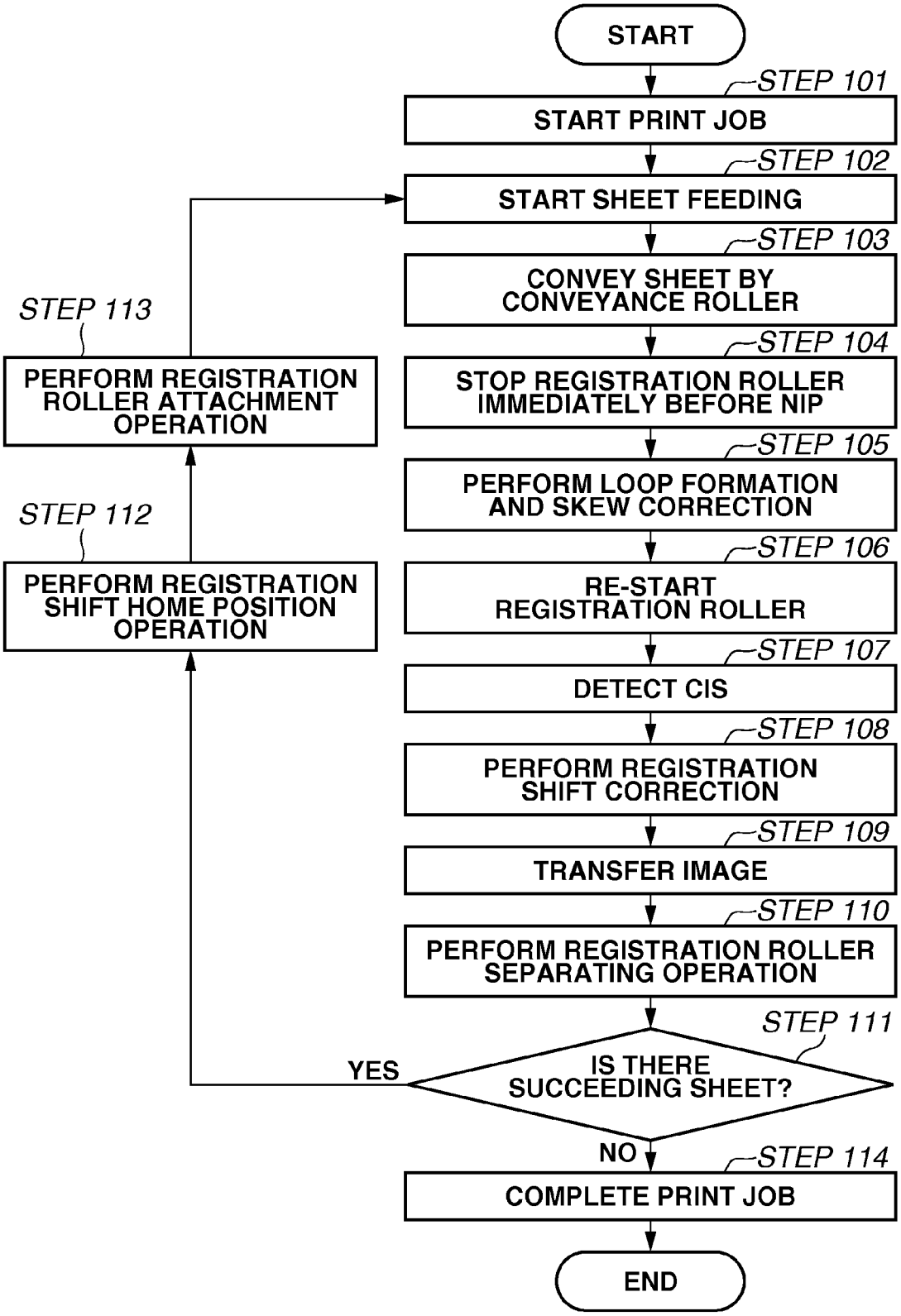
FIG. 5 is a flowchart for the image forming apparatus according to the first exemplary embodiment.
Figure 6A:
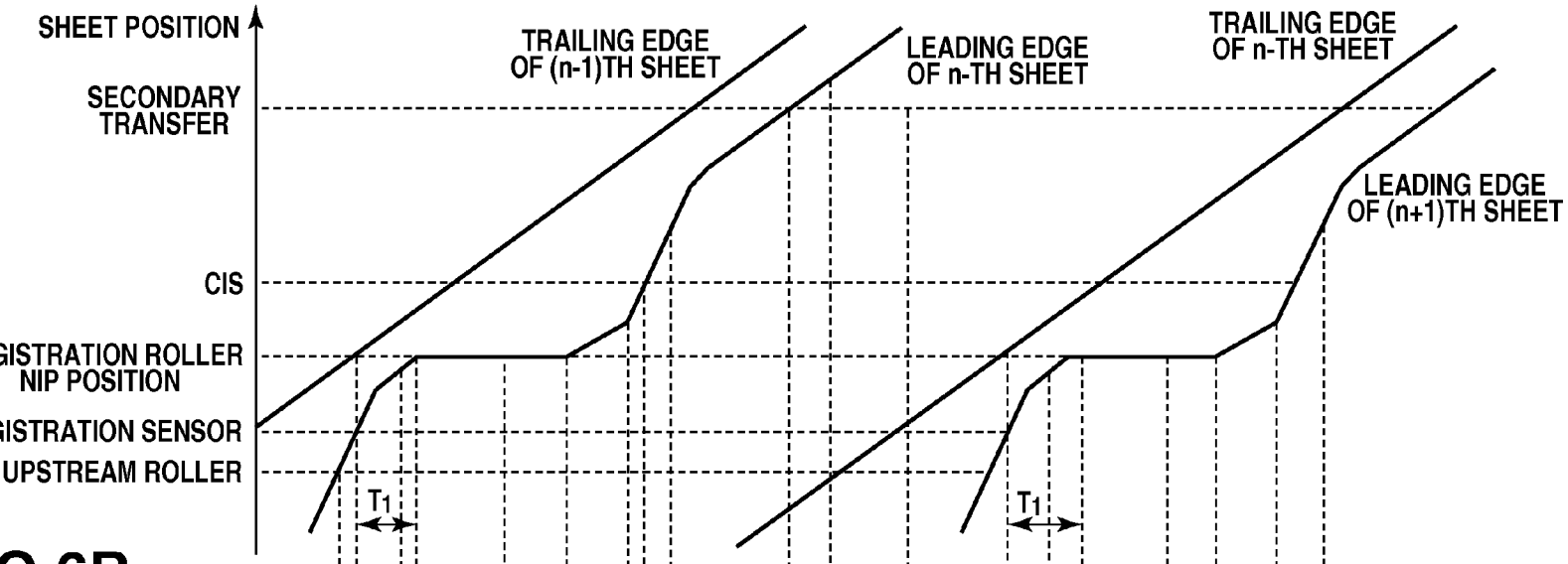
FIGS. 6A and 6B are a conveyance chart and a drive chart according to the first exemplary embodiment, respectively.
Figure 6B:
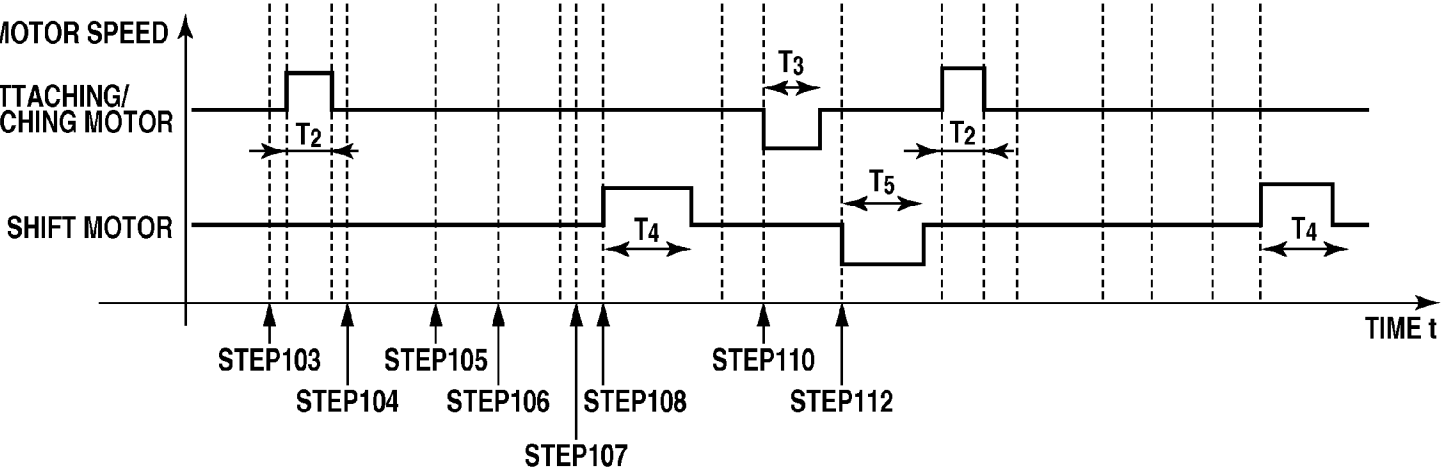

FIG. 5 is a flowchart illustrating a control flow by the CPU 50, FIG. 6A is a diagram illustrating the positions of the leading edge and the trailing edge of a sheet in successive sheet passing, and FIG. 6B is a drive chart of the attaching/detaching motor 151 and of the shift motor 43. In FIGS. 6A and 6B, the horizontal axis indicates time, and the vertical axis indicates a sheet position.

First, in step S101, the user executes a print job from an operation unit 200 of the image forming apparatus, or from a computer 201 connected to the image forming apparatus directly or via a network. In step S102, when the print job is executed, the sheet feeding operation is started. Then in step S103, the sheet is conveyed by the upstream roller pair 115, and the sheet is conveyed to the registration sensor 141.

In step S104, when the registration sensor 141 detects the conveyed sheet, the upstream roller pair 115 stops rotation to temporarily stop the sheet immediately before the nip portion of the registration roller pair 120. In step S105, after a predetermined period of time has elapsed, the controller 50 controls the driving of the upstream roller drive motor 62, starts the rotation of the upstream roller pair 115, and causes the sheet leading edge to abut the registration roller pair 120, performing skew correction operation by forming a loop in the sheet.

Then, in step S106, the controller 50 causes the registration roller pair 120 and the upstream roller pair 115 to restart simultaneously, thereby conveying the sheet downstream while maintaining the state in which the skew has been corrected.

In step S107, a position of the end portion in the width direction of the sheet conveyed downstream by the registration roller pair 120 is detected by the CIS 143. The controller 50 calculates a deviation amount in the width direction between the sheet end position detected by the CIS 143 and the normal position. In step S108, the controller 50 controls the shift motor 43 so as to move the registration roller pair 120 in the width direction by the calculated deviation amount, whereby the sheet position in the width direction is corrected. Here, the normal position refers to the position of the sheet end portion when the sheet is conveyed without any deviation of its position in the width direction, and is determined for each sheet size. The controller 50 prestores a table in which each sheet size corresponds to the normal position of the end portion of the sheet. And, according to the position in the width direction of the end portion detected by the CIS 143, the controller 50 refers to the table to determine a movement amount in the sheet width direction of the registration roller pair 120.

In step S109, when a period of time $T_4$ has elapsed from the start of the correction in the width direction, and positional correction has been completed on the sheet, the sheet is conveyed to the secondary transfer unit, where image transfer to the sheet is performed. In step S110, after the leading edge of the sheet has advanced by a predetermined amount beyond the secondary transfer unit, the central processing unit (CPU) 50 separates the registration roller pair 120 by the attaching/detaching motor 151 (operation time $T_3$).

Then, in step S111, it is determined whether there is any succeeding sheet. When there is a succeeding sheet (YES in step S111), the shift motor 43 is driven in the reverse direction by the same amount as the shift amount in step S108. As a result, in step S112, the registration roller pair 120 is returned to the initial position in the width direction (hereinafter referred to as the shift home position operation (operation time $T_4$). In step S113, by the time when the succeeding sheet reaches the registration roller pair 120 after the trailing edge of the preceding sheet has passed the registration roller pair 120, a registration roller contact operation is performed (operation time $T_2$). In step S114, when there is no succeeding sheet (NO in step S111), the print job is ended.

More specifically, in the present exemplary embodiment, the controller 50 controls the shift motor 43 and the attaching/detaching motor 151, and moves the registration roller pair 120 pinching the sheet in the width direction from the initial position before separating the registration roller pair 120. Further, the controller then controls the shift motor 43 and the attaching/detaching motor 151 so as to move the registration roller pair 120 in the width direction to the initial position in the state in which the registration roller pair 120 is separated.

Here, the reason for performing the shift home position operation with the registration roller pair 120 separated will be described. This is because the inter-sheet interval $T_1$ (the period of time from the trailing edge of the preceding sheet to the leading edge of the succeeding sheet in the registration roller pair 120) is shorter than the shift home position operation time $T_5$. In other words, it is impossible to perform the sheet position operation in time before the leading edge of the succeeding sheet reaches the registration roller pair 120 after the trailing edge of the preceding sheet has passed the registration roller pair 120.

In consideration of recent advancement in speed-up of image forming apparatuses and the skew correction mechanism of the present exemplary embodiment in which the sheet is stopped by the registration roller pair 120, $T_1$ is set to be shorter in many cases. Thus, as described above, it is desirable to perform the shift home position operation, with the registration roller pair 120 separated, before the trailing edge of the preceding sheet passes the registration roller pair 120.

In most cases, at the time of shifting, the trailing edge of the sheet remains pinched by a plurality of rollers (e.g., the upstream roller pair 115). When shift operation is performed in this state, twist is generated in the loop formed between the registration roller pair 120 and the upstream roller pair 115, and a force to turn the sheet works on the registration roller pair 120. When the turning force exceeds the pinching force of the registration roller pair 120, the skew may deteriorate at the registration roller pair 120.

In order to precisely perform matching of the image with the leading edge of the sheet, and, in order to prevent generation of sheet slippage during conveyance of the sheet, the pinching pressure of the registration roller pair 120 is generally set to be higher than that of the other conveyance rollers. In addition, to prevent slippage due to the twist in the loop as described above, it is desirable to set the pinching pressure as high as possible.

In particular, thick paper, which has high rigidity, receives a larger turning force, so that it can slip easily. Therefore, in the present exemplary embodiment, the pinching pressure of the registration roller pair 120 is set to be 4 kgf, whereas the normal conveyance roller pressure is 1 kgf. In this way, the registration roller pair 120 exhibits a relatively high pinching pressure as conveyance rollers. Thus, when this is separated, a large sliding-contact force is exerted between the cam surface of the above-mentioned cam 155 and the cam follower 156.

In Japanese Patent Application Laid-Open No. 2008-50069, in the case where the cam follower is shifted together with the conveyance roller, whereas the cam is not shifted, this sliding-contact force constitutes the resistance force when the shift home position operation is performed in the separated state. As a result, not only does the load torque due to the shift motor increase, but also wear due to the sliding contact progresses. Thus, in some cases, it becomes impossible to attain an appropriate roller separation amount. Further, shift precision may deteriorate through deformation of the shift mechanism due to the sliding-contact force.

The present exemplary embodiment aims to provide a configuration in which this sliding-contact force does not affect the shift home position operation. For this purpose, the present exemplary embodiment is equipped with the separation mechanism and the shift mechanism as described above.

More specifically, in the present exemplary embodiment, the registration roller pair 120, the springs 124*a* through 124*f* applying a pinching pressure to the registration roller pair 120, the cam 155, and the cam follower 156 are all shifted integrally. Further, in the present exemplary embodiment, the profile of the cam 155 is designed so that the separation state is maintained even if the drive of the attaching/detaching motor 151 is cut off when the cam 155 is driven to separate the registration roller pair 120.

Thus, the present exemplary embodiment is free from the influence of the sliding-contact force due to the springs 124*a* through 124*f* even if the shift home position operation is performed with the registration roller pair 120 separated. As a result, the following effects can be attained.

Since the requisite torque for the shift can be reduced, it is possible to achieve a reduction in the size of the shift motor 43. Further, since the deformation of the shift mechanism due to the sliding-contact force can be reduced, it is possible to achieve improvement in terms of shift precision.

An inertial force of the registration roller pair 120 is not small, and acceleration torque and deceleration torque at the time of shift operation tend to be large. According to the present exemplary embodiment, there is no influence of the torque due to the above sliding-contact force, so that it is possible to make acceleration and deceleration larger accordingly, which enables further reduction of the requisite time for the shift operation. As a result, the present exemplary embodiment is also applicable to an image forming apparatus with higher productivity.

Since the pinching pressure of the registration roller pair 120 can be set to high, slippage during the conveyance of the sheet to the image forming unit, and slippage at the time of shift are not easily caused, thus improvement in terms of image printing precision can be achieved.

While in the above-described example a conveyance roller pair which is shifted in the width direction and is separable is the registration roller pair provided on the upstream side of the image forming unit forming an image on the sheet, the scope of application of the present invention is not limited thereto. For example, a sheet alignment apparatus or the like is also provided with a conveyance roller pair for performing correction in the width direction, and the same effect can be expected if the configuration of the present exemplary embodiment is applied thereto.

Further, while in the above-described example, the tension springs 124*a* through 124*f* are hooked in a U-shaped fashion, the scope of application of the present invention is not limited thereto. The urging portion applying a pinching force to the conveyance roller pair may also be a compression spring, a plate spring or the like.

According to the present exemplary embodiment, the moving portion moves the conveyance roller pair, the urging portion, and the releasing portion in a direction intersecting with the sheet conveyance direction. Thus, it is possible to reduce the sliding-contact force due to the urging portion when the moving portion moves the conveyance roller pair with the pinching force of the conveyance roller pair released by the releasing portion.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-214817 filed Oct. 15, 2013, which is hereby incorporated by reference herein in its entirety.

What is claimed is:

1. A sheet conveyance apparatus comprising:

a conveyance roller pair that includes a first roller and a second roller, and is configured to convey a sheet;

an urging portion configured to apply a pinching force to the conveyance roller pair;

a releasing portion configured to release the pinching force of the conveyance roller pair against an urging force of the urging portion; and a moving portion configured to move the conveyance roller pair, the urging portion, and the releasing portion in a width direction intersecting with a sheet conveyance direction.

2. The sheet conveyance apparatus according to claim 1, wherein the releasing portion separates the first roller and the second roller from each other, thereby releasing the pinching force of the conveyance roller pair.

3. The sheet conveyance apparatus according to claim 1, wherein the releasing portion includes a cam provided coaxially with the second roller, and a cam follower provided coaxially with the first roller and held in contact with the cam, and wherein the first roller is separated from the second roller through movement of the cam follower due to rotation of the cam.

4. The sheet conveyance apparatus according to claim 1, further comprising a control unit configured to control a drive source of the releasing portion and a drive source of the moving portion, wherein the control unit releases the pinching force of the conveyance roller pair after moving the conveyance roller pair from an initial position with the conveyance roller pair pinching the sheet, and then moves the conveyance roller pair to the initial position with the pinching force of the conveyance roller pair released.

5. The sheet conveyance apparatus according to claim 1, further comprising a detection unit configured to detect an end portion in the width direction of the sheet conveyed by the conveyance roller pair, wherein the control unit controls the moving portion based on a detection result of the detection unit.

6. The sheet conveyance apparatus according to claim 1, wherein the releasing portion has a cam provided coaxially with the second roller, and a cam follower provided coaxially with the first roller and held in contact with the cam, the sheet conveyance apparatus further comprising:

a motor;

a first gear to which a drive force from the motor is transmitted; and a second gear in mesh with the first gear and configured to transmit the drive force, transmitted to the first gear, to the cam, wherein the second gear is moved by the moving portion in the width direction with respect to the first gear.

7. The sheet conveyance apparatus according to claim 1, wherein the conveyance roller pair is a registration roller pair arranged on an upstream side of the image forming unit, wherein the image forming unit is configured to form an image on the sheet.

8. A sheet conveyance apparatus comprising:

a first roller portion;

a second roller portion configured to convey a sheet while pinching the sheet with the first roller portion;

a separating portion that includes a cam configured to be rotated by a drive transmitted thereto, and a cam follower provided on either of the first roller portion or the second roller portion and held in contact with the cam, wherein the separating portion is configured to separate the first roller portion and the second roller portion from each other; and a moving portion configured to move the first roller portion, the second roller portion, the cam, and the cam follower integrally in a width direction orthogonal to a sheet conveyance direction.

9. The sheet conveyance apparatus according to claim 8, further comprising a spring configured to urge one of the first roller portion and the second roller portion toward the other of the first roller portion and the second roller portion, wherein the spring is arranged so as to be moved by the moving portion in the width direction integrally with the first roller portion, the second roller portion, the cam, and the cam follower.

10. The sheet conveyance apparatus according to claim 8, further comprising:

a motor;

a first gear to which a drive force from the motor is transmitted; and a second gear in mesh with the first gear and configured to transmit the drive force, transmitted to the first gear, to the cam, wherein the second gear is moved by the moving portion in the width direction with respect to the first gear.

11. An image forming apparatus comprising:

a sheet conveyance apparatus according to claim 1; and an image forming unit configured to form an image on a sheet.

* * * * *